United States Patent [19]

Hastings

[11] Patent Number: 4,478,370

[45] Date of Patent: Oct. 23, 1984

[54] AIR ATOMIZING NOZZLE ASSEMBLY

[75] Inventor: Donald R. Hastings, Elyria, Ohio

[73] Assignee: Nordson Corporation, Amherst, Ohio

[21] Appl. No.: 360,103

[22] Filed: Mar. 19, 1982

[51] Int. Cl.[3] ..... B05B 5/02

[52] U.S. Cl. ..... 239/707; 239/296; 239/600; 239/708

[58] Field of Search ..... 239/290, 296–300, 239/704–708, 600, 424, 424.5

[56] References Cited

U.S. PATENT DOCUMENTS

| | | | |
|---|---|---|---|
| 1,736,356 | 11/1929 | Mueller | 239/300 |
| 1,786,394 | 12/1930 | Tracy . | |
| 1,788,810 | 1/1931 | Tittemore . | |
| 1,797,209 | 3/1931 | Bramsen et al. | 239/300 |
| 1,990,823 | 2/1935 | Gustafsson . | |
| 2,042,746 | 6/1936 | Tracy . | |
| 2,107,732 | 2/1938 | Gustafsson et al. | 239/290 |
| 2,138,300 | 11/1938 | Gustafsson . | |
| 2,152,767 | 4/1939 | McKnight | 239/300 |
| 2,228,226 | 1/1941 | Downs | 239/300 |
| 2,304,857 | 12/1942 | Stahl . | |
| 2,479,507 | 8/1949 | Peeps . | |
| 2,511,356 | 6/1950 | Mantle . | |
| 2,537,038 | 1/1951 | Dalrymple . | |
| 2,827,330 | 3/1958 | Baur . | |
| 3,520,480 | 7/1970 | Halvorsen . | |
| 3,672,569 | 6/1972 | Smead et al. . | |
| 3,692,241 | 9/1972 | Walberg . | |
| 4,009,829 | 3/1977 | Sickles . | |
| 4,214,709 | 7/1980 | Scull et al. | 239/705 |
| 4,219,157 | 8/1980 | Binoche . | |
| 4,266,721 | 5/1981 | Sickles | 239/707 |
| 4,273,293 | 1/1981 | Hastings | 239/705 |
| 4,392,617 | 7/1983 | Bakos et al. | 239/424.5 |

FOREIGN PATENT DOCUMENTS

| | | | |
|---|---|---|---|
| 1157823 | 7/1969 | United Kingdom | 239/424 |

*Primary Examiner*—John J. Love
*Assistant Examiner*—Michael J. Forman
*Attorney, Agent, or Firm*—Wood, Herron & Evans

[57] ABSTRACT

An air atomizing nozzle assembly for electrostatic spray guns is disclosed. The nozzle assembly is made of plastic parts and includes an air cap having a central bore which surrounds a fluid nozzle tip. The nozzle has a nut formed on its forward end to facilitate threading of the rearward end of the nozzle tip into a threaded bore of the gun body. Formed on the front part of the nozzle, either as a part of the nut or a cylindrical surface adjacent the nut, is an accurately machined surface engageable in press fit relationship with a mating accurately machined bore of the air cap. These mating press fit surfaces center the bore of the air cap relative to the nozzle tip so as to leave an annular, evenly dimensioned air flow passage surrounding the nozzle tip and defined between the nozzle tip and the bore of the air cap. The air cap is retained in a one-piece resilient retaining ring by snapping the air cap into an annular lip of the retaining ring. The retaining ring is then threaded onto the gun body to secure the nozzle assembly onto the gun body.

20 Claims, 9 Drawing Figures

AIR ATOMIZING NOZZLE ASSEMBLY

This invention relates to electrostatic spray systems and particularly to an improved nozzle assembly for electrostatic spray guns. More specifically, this invention relates to an external air atomizing nozzle assembly for electrostatic spray guns such as that disclosed in Hastings, et al U.S. Pat. No. 3,747,850 issued on July 24, 1973, or Hastings U.S. Pat. No. 4,273,293; both of which are assigned to the assignee of this invention.

In conventional electrostatic spray systems, a fluid coating material such as paint, varnish, lacquer and the like is passed through the barrel of a spray gun, into a fluid nozzle which is threaded at its rear into a counterbore in the forward end of the barrel, and through and out of a small diameter bore in the nozzle tip at the forward end of the nozzle. An air cap surrounds the forward end of the nozzle and includes a central bore surrounding the tip of the nozzle so as to define an annular air passage around the nozzle tip. Air issuing from this annular passage impacts with the stream of material issuing from the material orifice of the nozzle to at least coarsely atomize the material stream. There may be additional openings or ports in the air cap to further atomize or control the material stream as well as a pair of fan-shaping ports located in a pair of opposed horns of the air cap. A trigger operated valve controls the flow of air through the atomizing air passage, and a manually adjustable valve controls the amount of air issuing from the horn of the nozzle and thus the degree of "fan" formed by the atomized spray. Patents generally illustrating such systems are U.S. Pat. Nos. 1,655,254; 2,101,175; 2,138,300; 3,672,569 and 3,747,850.

In such systems, it is of utmost importance that the annular air passage defined by the wall of the central bore in the air cap and the outside diameter of the fluid nozzle tip be accurately concentric with the material orifice of the nozzle. If this concentricity deviates by as little as one or two one-thousandths of an inch, atomization of the material becomes non-uniform and the shape of the spray emitted from the gun becomes badly distorted. Because the fluid tip has in the past usually been supported at its rearward end removed from the nozzle, it has been extremely difficult to obtain the accurate alignment of the nozzle tip in the central bore. This is particularly true when the nozzle assembly is formed of a nonconductive material such as plastic since it is particularly difficult to manufacture plastic parts in the tolerances required to achieve concentricity.

The problem of controlling the atomization of the fluid material and the shape of the spray emitted from the gun increases as the flow rate of material through the gun decreases. In sum, very small variations in the annular air passage surrounding the fluid nozzle tip have been found to have very drastic effects on the shape of the spray pattern emitted from the gun.

In Hastings U.S. Pat. No. 4,273,293 there is disclosed a solution to the problem of controlling atomization and the shape of the spray patterns emitted from an electrostatic air spray gun. This solution comprises accurately positioning the central bore of the air cap around the nozzle tip by machining a plurality of axially aligned holes evenly spaced about the circumference of the bore and having those holes intersect the bore so that the holes define a plurality of uniformly dimensioned, circumferentially spaced ribs between the holes. These ribs are engageable with the peripheral surface of the nozzle tip to align the center axis of the nozzle concentric with the center axis of the air cap bore. The difficulty with this solution to the problem is that it is very difficult and expensive to accurately machine the plurality of holes and ribs in the air cap so as to establish this concentricity. Furthermore, the ribs between the holes reduce the air flow rate through the air flow passage such that it is difficult to obtain sufficient air flow for many applications.

It has been among the principal objects of this invention to provide an atomizing nozzle for an electrostatic spray gun having the improved relative concentricity between the material orifice at the forwardmost end of the fluid tip and the atomizing opening in the center of the air cap of U.S. Pat. No. 4,273,293 but at substantially less manufacturing cost.

It has been a further objective of this invention to obtain such improved control and uniformity of material spray pattern, particularly in an economically less expensive nozzle assembly formed of a nonconductive material.

It has been a still further objective of this invention to provide an economical nozzle assembly for an electrostatic spray gun which is rugged in construction and relatively simple to manufacture but which accurately aligns the nozzle in the central bore of the air cap to achieve uniformity in spray pattern and fine atomization without the use of air flow restricting ribs between the nozzle tip and the air cap bore.

These objects and others of the present invention are achieved by providing an improved nozzle assembly for an electrostatic spray gun including a nozzle and an air cap which cooperate to form an annular uniformly dimensioned, evenly spaced gas flow channel surrounding the nozzle of an air spray nozzle assembly. Gas flowing through this annular channel converges symmetrically against the material emitted from the fluid tip nozzle to transform the material stream into a uniform and finely atomized pattern. The nozzle assembly of this invention provides a uniform spray pattern even when the nozzle is formed of a plastic material.

In accordance with the presently preferred form of the invention, the nozzle is threaded at its rear into a counterbore in the forward end of the barrel of the electrostatic spray gun and includes a bore through which the coating material passes. At the forward end of the nozzle there is a nut or flats formed on the periphery of this nozzle to facilitate threading of the rear of the nozzle into the counterbore at the forward end of the barrel. The air cap surrounds the forward end of the nozzle and has a central bore through which a gas, e.g., air, is ejected for atomizing the coating material. According to the practice of this invention, the nut on the front of the nozzle or a cylindrical portion of the nozzle adjacent the nut, has an accurately machined surface formed on the periphery thereof and engageable in press fit relationship with an accurately machined surface of the bore of the air cap. The nozzle tip is thereby supported at its rear end by the barrel and at its forward or nozzle tip end by the press fit engagement of the accurately machined outside diameter portion of the nozzle with the accurately machined inside diameter of the central bore of the air cap. The air cap and nozzle thus cooperate to form an annular flow passage of uniform dimension around the nozzle tip to thereby produce a uniform atomizing air flow pattern around the nozzle tip.

These and other objects and advantages of this invention will be more readily apparent from the following detailed description of the invention taken with the accompanying drawings.

Figure 1:
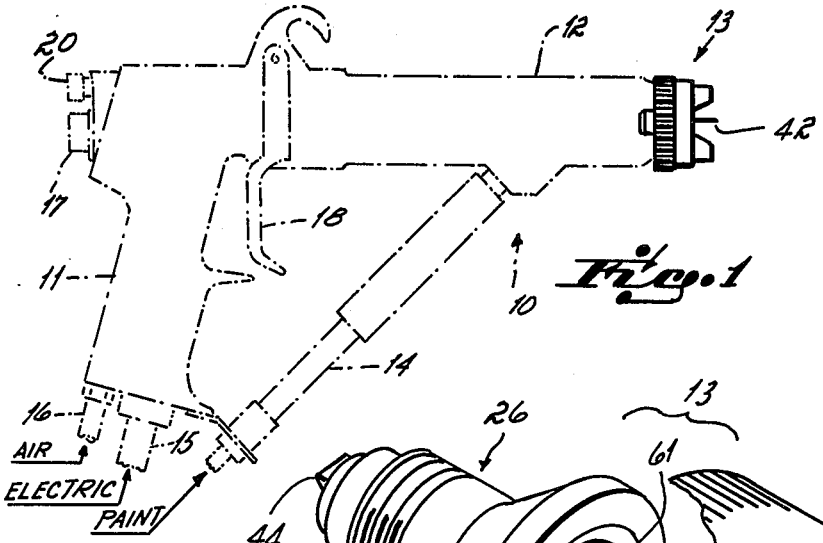
FIG. 1 is a side elevational view showing in phantom a manually operated electrostatic air spray gun incorporating the nozzle assembly of this invention (shown in solid)

The gun 10 illustrated in FIG. 1 of the drawings is an air operated electrostatic spray gun which relies upon the impact of an air stream with liquid stream to effect atomization of the liquid stream. While the invention is described as applied to an air gun, it should be understood, though, that the invention is equally applicable to all electrostatic spray guns or to spray systems in general.

The gun 10 shown in phantom in FIG. 1 is described in detail in the Hastings et al U.S. Pat. No. 3,747,850, which is incorporated herein by reference. The gun is generally described here only for purposes of illustrating the application of the present invention, and those skilled in the art are referred to the aforementioned patent for the details of its construction and operation.

The gun 10 comprises an electrically conductive metal handle assembly 11, an electrically insulative barrel assembly 12, and an insulative nozzle assembly 13. Paint or other spray material which may be in the nature of a coating, varnish, or lacquer (referred to in regard to this invention generically as paint) is supplied to the gun from an external reservoir or tank (not shown) through a material passage 14. A high voltage source of electrical energy is supplied to the gun by a cable 15 from an external electrical power pack (not shown).

The handle assembly 11 is generally made from a metal casting and includes an air inlet 16, a trigger actuated internal air flow control valve 17 and a trigger 18 for controlling the flow of air through the valve 17. There is also an adjustable air valve 20 in the gun handle for controlling the shape or "fan" of the spray emitted from the gun.

Figure 5:
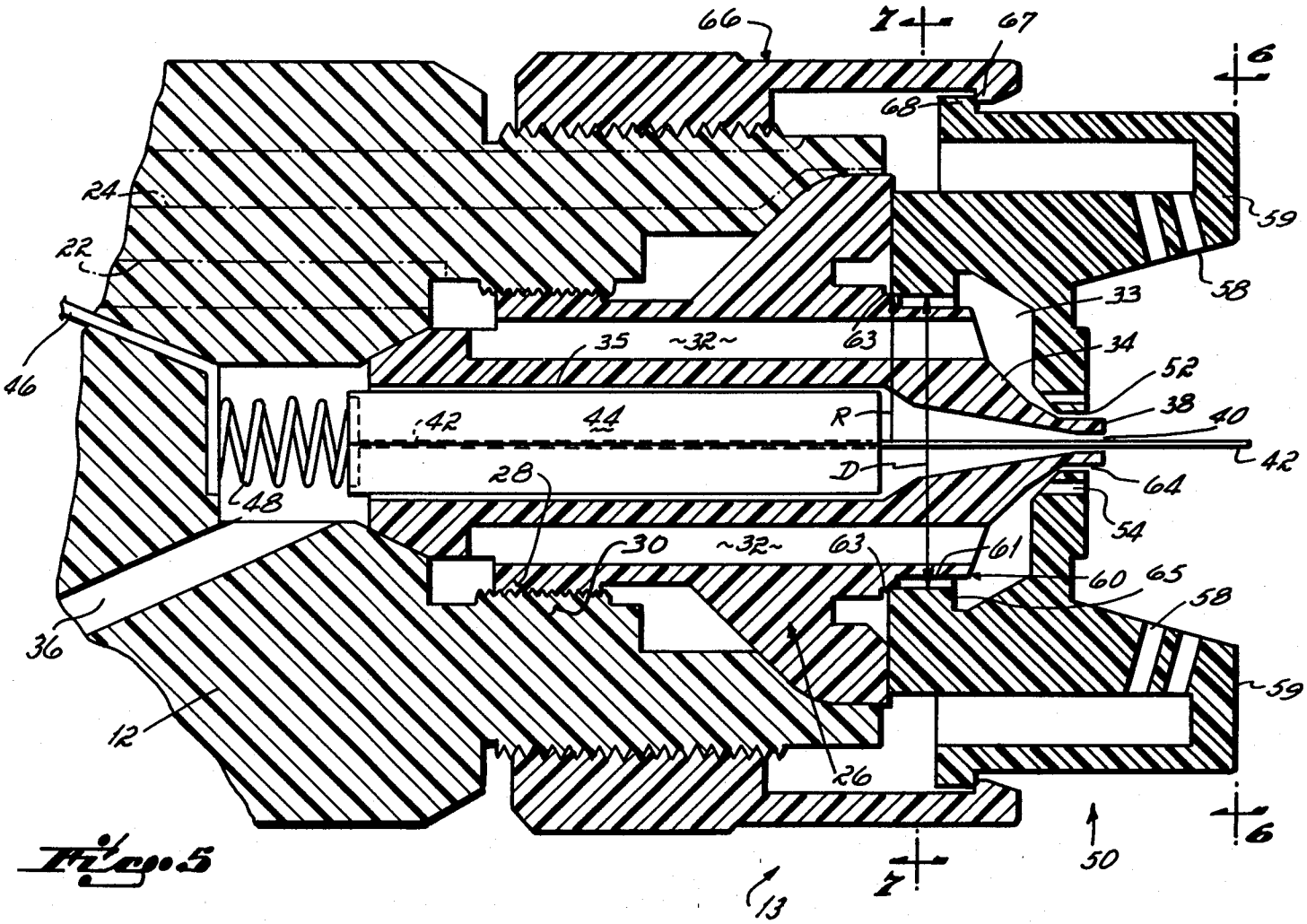
FIG. 5 is an axial cross sectional view of the nozzle assembly of this invention.

The air inlet 16 opens into a generally vertical air passage in the handle 11 which communicates through the air flow control valve 17 with a pair of internal passages 22, 24 passing through the barrel 12 of the gun and terminating at the forward end of the barrel 12 (FIG. 5). The passage 22 provides atomizing air while passage 24 provides the fan-shaping air. The flow of air through passages 22, 24 is controlled by the trigger operated air control valve 17 while the flow of fan air through the passage 24 is further controlled by the fan control valve 20.

Figure 2:
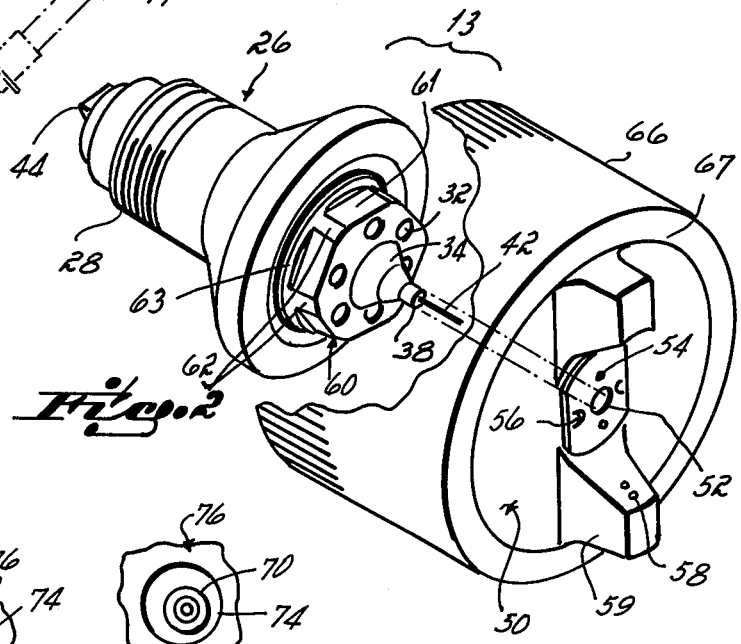
FIG. 2 is an exploded perspective view with part broken away of the nozzle assembly of this invention.

Referring now to FIGS. 2 and 5, the nozzle assembly 13 is made from an electrically nonconductive material. It comprises a nozzle 26 which is threaded at its rear 28 into a counterbore 30 in the forward end of the barrel 12. Nozzle 26 has six circumferentially spaced axial passages 32 which open into the rear of the counterbore 30 which in turn communicate with the air passage 22 such that atomizing air passing through the passage 22 may enter and pass through the axial passages 32 in the nozzle and into an internal chamber 33 surrounding the forward end 34 of the nozzle 26. The nozzle 26 also has a central axial passage 35 communicating with a material flow passage 36 in the barrel 12 for supply of liquid or fluid via the passage 14 (FIG. 1) from the tank or reservoir.

Figure 7:
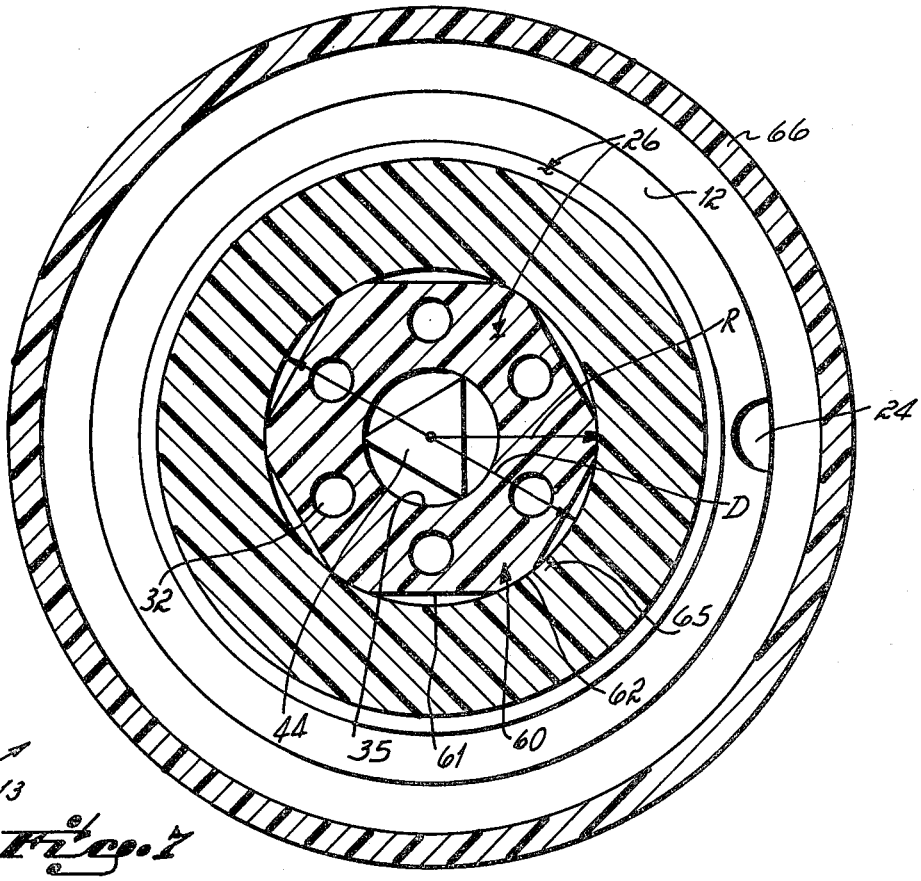
FIG. 7 is a cross sectional view taken on line 7—7 of FIG. 5.

The forward end 34 of the nozzle is generally tapered and terminates in a nozzle tip 38 having a small diameter orifice 40 through which the coating material is emitted. Immediately rearward of the tapered section 34 of the nozzle, a hexagonal nut 60 is formed on the periphery of the nozzle. This nut facilitates threading of the threaded rear 28 of the nozzle into the threaded counterbore 30 of the gun barrel 12. With reference to FIGS. 2 and 7, it will be seen that the flats 61 of this nut 60 have their intersecting corners rounded or radiused as indicated at 62. As explained more fully hereinafter, these radiused surfaces 62 may function as a press fit surface on the front of the nozzle 26 engageable with a press fit internal diameter surface of the air cap. As an alternative to the rounded corners 62 of the nut functioning as a press fit surface on the front of the nozzle engageable with a press fit internal diameter surface of the air cap 50, a cylindrical section 63 of the nozzle of the same radius R as the rounded corners 62 may serve the same function or act to supplement the same press fit function.

A material ionizing electrode or antenna 42 is mounted on the center axis of the nozzle and is held in place in the passage 35 by means of a nonconductive holder 44 (FIG. 7). Electrical power is supplied to the electrode 42 which protrudes from the orifice 40 of the nozzle tip 38. This power is supplied generally from the electrical power pack which is connected to the gun via a cable 15 which is connected to the electrode 42 via an insulated cable 46 and spring 48.

Figure 6:
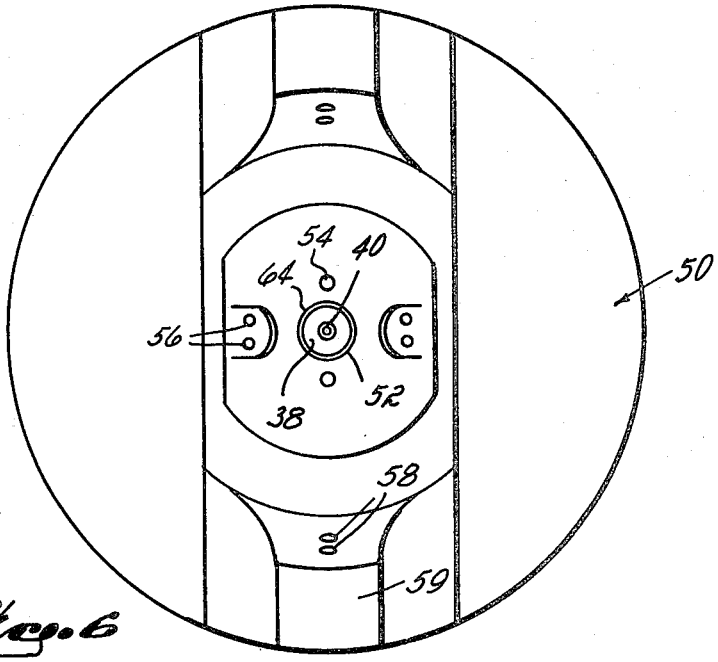
FIG. 6 is an end elevational view taken on line 6—6 of FIG. 5.

The air cap 50 surrounds the forward end 34 of the nozzle 26. It includes a central bore 52 through which the nozzle tip 38 extends, a pair of fan control ports 54, one located on either side of the bore 52, two pairs of recessed fine atomizing ports 56, and a pair of ports 58 in each air horn 59. Referring now in addition to FIGS. 5 and 6 it will be seen that the surface of the central bore 52 is spaced from the internal surface of the nozzle tip 38 such that an annular air flow passage 64 is defined therebetween. This annular air passage 64 opens into the internal air chamber 33 such that air flow into the chamber 33 exits through the annular passage 64.

Extending inwardly into the air chamber 33 of the air cap 50, there is a flange 65. This flange has an internal diameter D the same as or slightly smaller than the external diameter of the cylindrical section 63 of the nozzle and between the rounded corners 62 of the nut section 60 of the nozzle such that when assembled, the flange 65 is press fit onto the nut section 60 and/or the cylindrical section 63 of the nozzle 26. This press fit enables this air cap 50 to be concentrically mounted onto the nozzle with the axis of the air cap bore 52 nearly perfectly concentric with the axis of the nozzle 26 and nozzle orifice 46. The press fit surfaces thus align the nozzle such that the center axis of the material orifice 40 is on the center axis of the central bore 52. The co-action of the fluid tip nozzle with the air cap thus provides an annular air flow passage 64 uniformly spaced around the fluid tip nozzle thereby producing a uniform atomizing air flow pattern.

Figure 3A:
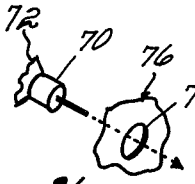
FIG. 3A is a partial exploded perspective view of a prior art nozzle.
Figure 3B:
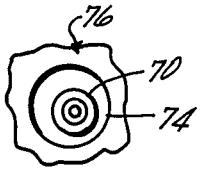
Fig. 3B PRIOR ART
FIG. 3B is an end view of the prior art nozzle shown in FIG. 3A.

This co-action may be further understood and appreciated by referring to FIGS. 3A and 3B wherein a prior art nozzle assembly is illustrated. Referring first to FIG. 3A, in the prior art, the nozzle end 70 of the fluid tip 72 extends through a central bore 74 in the air cap 76 which has a diameter greater than the outside diameter of the nozzle 70 to form an annular air passage around the nozzle. However, in the prior art, the fluid tip 72 is supported at points removed from the nozzle end 70 and because of inaccuracies in manufacture and dimensional instability, it is clearly not aligned in the central bore to provide a uniform annular air passage. Rather, the misalignment of the nozzle in the central bore, as illustrated in FIG. 3B results in a lack of concentricity of the air passage 74 about the nozzle and therefore nonuniform atomization of the material exiting the nozzle. As may be best seen in FIG. 6, the nozzle assembly of the present invention by virtue of the cooperation of the air cap 50 with the fluid tip nozzle 38 provides uniformly dimensioned air flow of passage 64 around the nozzle.

Figure 4A:
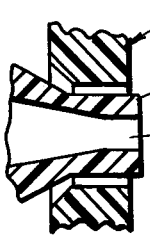
FIG. 4A is a cross sectional view of a second prior art nozzle.
Figure 4B:
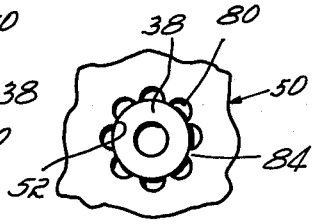
Fig. 4B PRIOR ART
FIG. 4B is an end elevational view of the prior art nozzle shown in FIG. 4A.

Still another prior art assembly is illustrated in FIGS. 4A and 4B. In this assembly a plurality of circumferentially spaced holes 80 whose axes are aligned with the axis of the central bore 52 are machined in the air cap 50. These holes 80 intersect the circumference of the central bore 52 so as to define a series of circumferentially spaced gas flow passages with spaced radially extending ribs 84 therebetween. The nozzle portion of the fluid tip 26 extends through the central bore 52 and the ribs 84 engage its outside diameter. In this prior art structure, the ribs 84 align the nozzle such that the center axis of the fluid orifice 40 is on the center axis of the central bore 52. The difficulty of this prior art structure is that the holes 80 are extremely difficult and expensive to machine and the ribs 84 partially obstruct the flow of air from the chamber 33 prior to engagement with the fluid stream emitted from the orifice 40.

The primary advantage of the invention of this application with its press fit surfaces on the outside diameter of the front of the nozzle 26 and inside diameter on the air cap 50 for effecting concentricity of the nozzle tip and air cap 50 and thus a uniform concentric air flow passage 64 about the nozzle tip 38, relative to the prior art illustrated in FIGS. 4A and 4B, is that it is less expensive to manufacture, maintains better concentricity of the assembled parts when produced on a production basis, and does not partially obstruct the air flow passage surrounding the nozzle tip.

The air cap 50 is mounted to the gun 10 by means of an annular retaining ring 66. The retaining ring 66 is also made from an electrically nonconductive plastic material. It is threaded over a threaded section of the barrel 12 at one end and at its other end has an annular lip 67. The retaining ring 66 although rigid is sufficiently flexible at the lip 69 to permit the air cap 50 to be snapped into position with the lip 67 engaging a ring 68 on the outside surface of the air cap 50 such that the air cap is securely retained and sealed against escape of air to the atmosphere.

Although the invention has been described in terms of a single preferred embodiment, those skilled in the art will recognize that other forms may be adopted within the scope of the invention. Moreover, those skilled in the art will appreciate that although the invention has been described in terms of electrostatic spraying, it is equally applicable to spray apparatus in general.

I claim:

1. In a system for the coating of articles with a liquid coating material supplied from a pressurized bulk coating source wherein said liquid coating material is emitted from a coating material spray device in the form of an atomized spray produced by impacting a central stream of liquid coating material under pressure with a pressurized gas stream encircling said central liquid stream and wherein the articles to be coated are spaced from said spray device, the combination comprising:

a source of liquid coating material under pressure;

a source of pressurized atomizing gas;

a material spray device having a liquid conduit with flow control means therein adapted to be connected to said source of pressurized liquid coating material, and having a gas conduit therein adapted to be connected to said source of pressurized atomizing gas; and a spray coating nozzle assembly which is substantially constructed of nonconductive plastic material comprising a nozzle connected at its rear end to said spray device and having a flow passage communicating with said liquid conduit, said nozzle having a nozzle tip through which said liquid coating material is emitted in a central stream, an air cap communicating with said atomizing gas conduit through which gas is ejected for impinging and atomizing said central stream of liquid coating material emitted from said nozzle tip of said nozzle, said atomizing gas being emitted from a uniformly dimensioned annular orifice surrounding said nozzle tip and defined by the exterior surface of said nozzle tip and an interior bore surface of said air cap, said air cap being supported by said spray device and being positionably located relative to said nozzle by interference press-fit engagement of an internal cylindrical diameter portion of said air cap with a mating outside diameter portion of said nozzle as as to positively align the center axis of said nozzle tip on the axis of said air cap bore surface to provide uniform atomizing gas flow around said nozzle tip for producing a finely atomized uniform spray pattern of said coating material emitted from said nozzle tip.

2. The system of claim 1 in which said nozzle has a nut formed on its forward end, said press fit outside diameter portion of said nozzle being at least partially located on said nut.

3. The system of claim 1 in which said nozzle has a cylindrical portion formed on its forward end, said press fit outside diameter portion of said nozzle being at least partially formed on said cylindrical portion of the nozzle.

4. The system of claim 1 wherein said spray device is an electrostatic spray gun and wherein said nozzle assembly includes an ionizing electrode protruding from said nozzle tip.

5. The system of claim 1 wherein the forward end of said nozzle tip protrudes forwardly of the outer surface of said air cap.

6. The system of claim 1 wherein said air cap further includes fan-shaping ports communicating with a source of atomizing gas through said spray device, said fan-shaping ports being sealed from said atomizing gas annular orifice by mating surfaces of said air cap and said nozzle, and means protruding from said nozzle tip for charging said material.

7. The system of claim 1 in which said nozzle is threaded at its rear end into a threaded section of said spray device.

8. The system of claim 1 in which said air cap is supported upon said spray device by a retaining ring, said retaining ring being threaded onto the forward end of said spray device.

9. The system of claim 8 in which said retaining ring has an inwardly extending flange snap-fit over an outwardly extending flange of said air cap.

10. A spray coating nozzle assembly for use in a system for the coating of articles with a liquid coating material supplied from a pressurized bulk coating source wherein said liquid coating material is emitted from a coating material spray device in the form of an atomized spray produced by impacting a central stream of liquid coating material under pressure with a pressurized atomizing gas stream encircling said central liquid stream and wherein the articles to be coated are spaced from said spray device, said nozzle assembly comprising;

a nozzle and an air cap constructed of nonconductive plastic material, said nozzle being adapted to be connected at its rear end to said spray device, said nozzle having a nozzle tip and a flow passage extending through said nozzle and nozzle tip, said flow passage terminating in an outlet orifice through which said liquid coating material is emitted in a central stream, an air cap having a chamber communicating with said atomizing gas conduit, said air cap having an axial bore communicating with said chamber, said air cap being located over at least the forward end of said nozzle so that the exterior surface of said nozzle tip and the interior surface of said axial bore of said air cap define a uniformly dimensioned annular orifice therebetween, said air cap being adapted to be supported by said spray device and being positionably located relative to said nozzle by interference press-fit engagement of a cylindrical portion of said air cap with a mating portion of said nozzle so as to positively align the center axis of said nozzle tip on the axis of said air cap axial bore to provide uniform atomizing gas flow around said nozzle tip for impinging upon said central stream of liquid coating material and producing a finely atomized uniform spray pattern of said coating material.

11. The nozzle assembly of claim 10 in which the press fit portion of said air cap is an internal diameter portion of the press fit portion of said nozzle in an outside diameter portion.

12. The nozzle assembly of claim 11 in which said nozzle has a nut formed on its forward end, said press fit outside diameter portion of said nozzle being at least partially located on said nut.

13. The nozzle assembly of claim 11 in which said nozzle has a cylindrical portion formed on its forward end, said press fit outside diameter portion of said nozzle being at least partially formed on said cylindrical portion of the nozzle.

14. The nozzle assembly of claim 10 wherein said nozzle assembly includes an ionizing electrode protruding from said nozzle tip.

15. The nozzle assembly of claim 10 wherein the forward end of said fluid nozzle tip protrudes forwardly of the outer surface of said air cap.

16. The nozzle assembly of claim 10 wherein said air cap further includes fan-shaping ports, said fan-shaping ports being sealed from said atomizing gas annular orifice by mating surfaces of said air cap and said nozzle, and means protruding from said nozzle tip for charging said material.

17. The nozzle assembly of claim 10 in which said nozzle is threaded at its rear end for threading into a threaded section of a spray device.

18. The nozzle assembly of claim 10 in which said air cap is adapted to be supported upon a spray device by a retaining ring, said retaining ring being adapted to be threaded onto the forward end of said spray device.

19. The nozzle assembly of claim 18 in which said retaining ring has an inwardly extending flange snap-fit over an outwardly extending flange of said air cap.

20. A spray coating nozzle assembly for use in a system for the coating of articles with a liquid coating material supplied from a pressurized bulk coating source wherein said liquid coating material is emitted from a coating material spray device in the form of an atomized spray produced by impacting a central stream of liquid coating material under pressure with a pressurized atomizing gas stream encircling said central liquid stream and wherein the articles to be coated are spaced from said spray device, said nozzle assembly comprising;

a nozzle and an air cap constructed of nonconductive plastic material, said nozzle being adapted to be connected at its rear end to said spray device, said nozzle having a nozzle tip and a flow passage extending through said nozzle and nozzle tip, said flow passage terminating in an outlet orifice through which said liquid coating material is emitted in a central stream, an air cap having a chamber adapted to communicate with a source of atomizing gas, said air cap having an axial bore communicating with said chamber, said air cap being located over at least the forward end of said nozzle so that the exterior surface of said nozzle tip and the interior surface of said axial bore of said air cap define an annular orifice therebetween, said air cap being adapted to be supported by said spray device and being positionably located relative to said nozzle by interference press-fit engagement of a cylindrical portion of said air cap with a mating portion of said nozzle so as to positively align the center axis of said nozzle tip on the axis of said air cap axial bore to provide uniform atomizing gas flow around said nozzle tip for impinging upon said central stream of liquid coating material and producing a finely atomized uniform spray pattern of said coating material.

* * * * *

UNITED STATES PATENT AND TRADEMARK OFFICE

CERTIFICATE OF CORRECTION

PATENT NO. : 4,478,370

DATED : Oct. 23, 1984

INVENTOR(S) : Donald R. Hastings

It is certified that error appears in the above-identified patent and that said Letters Patent is hereby corrected as shown below:

Col. 6, line 44, Claim 1, "as as" should be -- so as --

Signed and Sealed this

Thirtieth Day of July 1985

[SEAL]

*Attest:*

DONALD J. QUIGG

*Attesting Officer*

*Acting Commissioner of Patents and Trademarks*